US006966298B2

(12) United States Patent
Tsugami et al.

(10) Patent No.: US 6,966,298 B2
(45) Date of Patent: Nov. 22, 2005

(54) INTAKE THROTTLE VALVE APPARATUS

(75) Inventors: Hiromichi Tsugami, Tokyo (JP); Katsunari Takagi, Tokyo (JP); Shuzo Isozumi, Tokyo (JP); Teruhiko Moriguchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/800,721

(22) Filed: Mar. 16, 2004

(65) Prior Publication Data

US 2005/0133005 A1 Jun. 23, 2005

(30) Foreign Application Priority Data

Dec. 17, 2003 (JP) ..... 2003-419979

(51) Int. Cl.[7] ..... F02D 9/08
(52) U.S. Cl. ..... 123/399; 251/129.11
(58) Field of Search ..... 123/337; 251/305, 251/129.11

(56) References Cited

U.S. PATENT DOCUMENTS 4,690,119 A * 9/1987 Makino et al. ..... 123/568.23
5,016,586 A * 5/1991 Imamura et al. ..... 123/336
5,101,784 A * 4/1992 Tamaki ..... 123/337
5,868,114 A * 2/1999 Kamimura et al. ..... 123/399
6,341,593 B2 * 1/2002 Kamimura et al. ..... 123/337
6,626,421 B2 * 9/2003 Torii et al. ..... 251/305

FOREIGN PATENT DOCUMENTS

JP 06033804 A * 2/1994 ..... F02D 11/10

* cited by examiner

*Primary Examiner*—Henry C. Yuen
*Assistant Examiner*—Arnold Castro
(74) *Attorney, Agent, or Firm*—Sughrue Mion, PLLC

(57) ABSTRACT

An intake throttle valve apparatus comprising a throttle valve (1) including a housing (4), a valve shaft (7) rotatably supported within the housing (4) and a valve element (9) fixed on the shaft (7) for changing an opening area of an intake passage (8), a reduction gear train (2) operatively coupled to the throttle valve (1), and an electric motor (3) coupled to the gear train (2) so that a driving force of the driving motor (3) is transmitted to the valve shaft (7) through the gear train (2) for changing the opening area of the intake passage (8) by rotating the valve element (9). The gear train (2) includes an output gear (12) secured to a motor shaft (11) of the motor (3) and an input gear (13) secured to the valve shaft (7) at one end and directly meshing with the output gear (12).

8 Claims, 1 Drawing Sheet

INTAKE THROTTLE VALVE APPARATUS

BACKGROUND OF THE INVENTION

1. Field of the Invention

The present invention relates to an intake throttle valve apparatus for an internal combustion engine. More particularly, the present invention is concerned with an intake throttle valve apparatus whose valve element is rotated by a driving motor through a reduction gear mechanism in response to actuation or depression of an accelerator pedal.

2. Description of Related Art

Heretofore, such an intake throttle valve apparatus is known that the opening degree defined by a valve element of a throttle valve incorporated in the intake throttle valve apparatus is controlled by means of a driving motor through a reduction gear mechanism in response to manipulation or depression of the accelerator pedal.

In the hitherto known or conventional intake throttle valve apparatus mentioned above, torque generated by the driving motor is transmitted to a valve shaft supporting the valve element of the throttle valve through a reduction gear mechanism or train which includes an output gear fixedly mounted on a motor shaft of the driving motor, an intermediate gear meshing with the output gear and an input gear fixedly mounted on the valve shaft and meshing with the intermediate gear with a view to increasing the torque to a magnitude required for controlling the opening degree of the throttle valve. The reduction ratio of the reduction gear train is substantially "10" or more. For more particulars, reference may have to be made to Japanese Patent Application Laid-Open Publication No. 266666/2002 (JP-A-2002-266666).

The hitherto known or conventional intake throttle valve apparatus mentioned above however suffers a problem that the intermediate gear and a gear pin for supporting the intermediate gear are required for the torque transmission because the reduction gear train is implemented in a so-called two-stage speed reduction structure including the intermediate gear, and thus the number of constituent parts of the intake throttle valve apparatus increases correspondingly.

Moreover, in the conventional intake throttle valve apparatus, a relatively large inter-shaft or inter-axis distance is required between the output gear and the input gear because of interposition of the intermediate gear. Consequently, the size or dimension of the intake throttle valve apparatus is necessarily determined by the inter-axis distance and thus difficulty is encountered in implementing the intake throttle valve apparatus in a small size, giving rise to an additional problem. This problem becomes more remarkable from the standpoint of layout when the intake throttle valve apparatus is installed in a compact type gasoline engine car of cylinder volume of 1.0 liter or less. For coping with this problem, it may unwantedly become unavoidable to change or modify the specifications of the engine body as well as peripheral equipment, presenting a further problem.

SUMMARY OF THE INVENTION

In the light of the state of the art described above, it is an object of the present invention to provide an intake throttle valve apparatus of a structure which can be realized with a decreased number of constituent parts and in which the inter-axis distance between the motor shaft and the valve shaft supporting the valve element is decreased to thereby allow the intake throttle valve apparatus to be implemented in a small or reduced size.

In view of the above and other objects which will become apparent as the description proceeds, there is provided according to a general aspect of the present invention an intake throttle valve apparatus which includes an intake throttle valve composed of a valve housing, a valve shaft rotatably supported within the valve housing and a valve element fixedly mounted on the valve shaft for changing an opening area of an intake passage formed internally of the valve housing, a reduction gear mechanism operatively coupled to the intake throttle valve, and a driving motor operatively coupled to the reduction gear mechanism so that a driving force of the driving motor is transmitted to the valve shaft through the medium of the reduction gear mechanism for thereby changing the opening area (cross-sectional flow area) of the intake passage through rotation of the valve element.

In the intake throttle valve apparatus mentioned above, the reduction gear mechanism is composed of the output gear fixedly secured to the motor shaft of the driving motor and the input gear fixedly secured to the valve shaft at one end thereof and directly meshing with the output gear.

With the structure of the intake throttle valve apparatus described above, it is possible to decrease the number of constituent parts while reducing the inter-axis distance between the motor shaft and the valve shaft which supports the valve element, whereby the intake throttle valve apparatus can be implemented in a small or reduced size.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
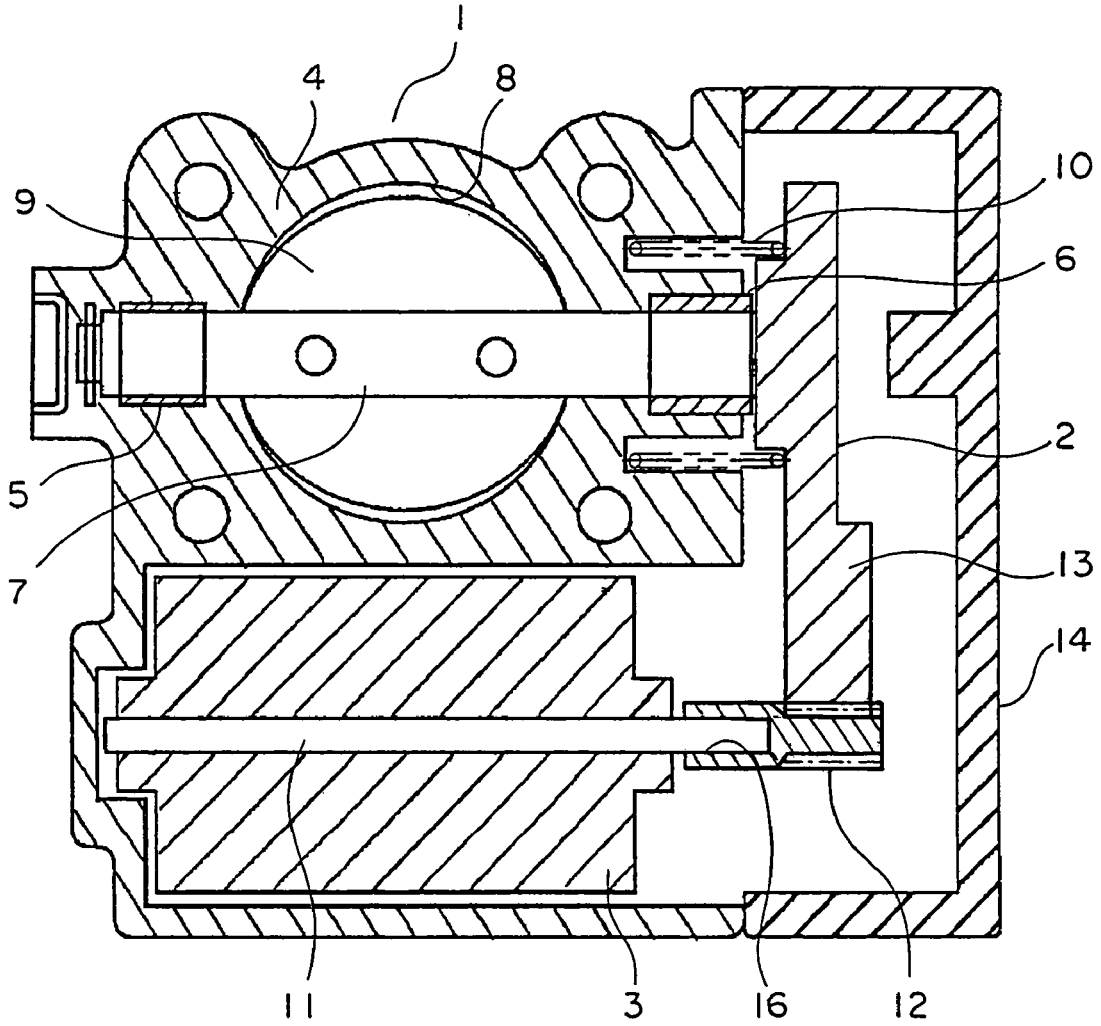
FIG. 1 is a sectional view showing an intake throttle valve apparatus according to an embodiment of the present invention.

The present invention will be described in detail in conjunction with what is presently considered as preferred or typical embodiment thereof by reference to the drawings. In the following description, like reference characters designate like or corresponding parts throughout the views. Also in the following description, it is to be understood that such terms as "right", "left" and the like are words of convenience and are not to be construed as limiting terms.

Embodiment 1

FIG. 1 is a sectional view showing an intake throttle valve apparatus according to a first embodiment of the present invention.

Referring to the figure, the intake throttle valve apparatus includes an intake throttle valve generally denoted by reference numeral 1, a reduction gear mechanism generally denoted by 2 which is operatively connected to the intake throttle valve 1 and a driving motor generally denoted by 3 which is operatively connected to the reduction gear mechanism 2.

The intake throttle valve 1 is composed of a valve housing 4 formed of a resin, a valve shaft 7 rotatably supported by means of a first bearing 5 and a second bearing 6 mounted in left-hand and right-hand walls of the valve housing 4, respectively, a valve element 9 fixedly mounted on the valve shaft 7 for changing the opening area (cross-sectional area) of an intake passage 8 formed internally of the valve housing 4, and a spring 10 disposed in the vicinity of the second bearing 6 for resiliently urging the valve shaft 7 in the direction to close the intake throttle valve 1.

The valve housing 4 may be formed of polyphthalamide (PPA) in a substantially cylindrical shape as viewed in the direction orthogonally toward the plane of FIG. 1 with the intake passage 8 being formed internally of the valve housing 4 as mentioned above.

The reduction gear mechanism 2 is composed of an output gear 12 fixedly secured on a motor shaft 11 of the driving motor 3 and an input gear 13 press-fit onto the valve shaft 7 at one end thereof and directly meshing with the output gear 12. The reduction gear mechanism 2 is covered with a cover cap 14. By the way, the input gear 13 is implemented in the form of a sector gear, as can be appreciated from FIG. 1.

Figure 2:
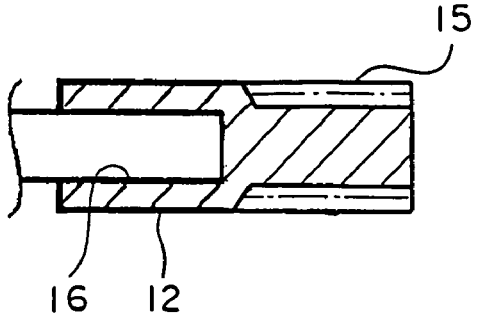
FIG. 2 is a sectional view showing an output gear of the intake throttle valve apparatus shown in FIG. 1.

Referring to FIG. 2, the output gear 12 is formed with a press fitting hole 16 at one end portion in which the motor shaft 11 of the driving motor 3 is fixedly secured by press fitting, while a gear-tooth portion 15 is formed at the other end portion of the output gear 12. In this conjunction, it should be added that the gear-tooth portion 15 is disposed in front of the tip end of the motor shaft 11 such that the motor shaft 11 and the gear-tooth portion 15 do not overlap with each other, as viewed in the diametrical direction of the output gear 12. The output gear 12 should preferably be fabricated through a sintering process or a cold forging process.

The module of the output gear 12 is in a range of "0.4" to "1.0" with the number of the teeth thereof being in a range of "4" to "8". On the other hand, the module of the input gear 13 is in a range of "0.4" to "1.0" with the number of the teeth thereof being in a range of "70" to "100". Thus, the reduction ratio of the gear train including the output gear 12 and the input gear 13 is around "10". By virtue of the reduction gear mechanism constituted by the gear train mentioned above, the torque generation by the driving motor 3 is increased to a magnitude required for controlling the opening degree of the valve element 9.

In the intake throttle valve apparatus of the structure described above, the air sucked through an air filter (not shown) disposed within an intake pipe of an internal combustion engine (not shown either) at a location upstream of the intake throttle valve apparatus is introduced into the intake passage 8 defined within the valve housing 4. In that case, the quantity or flow rate of the air as introduced is regulated or adjusted in dependence on the opening degree of the valve element 9 which is rotated against the elasticity of the spring 10 under the effect of the torque transmitted through the reduction gear mechanism 2 from the driving motor 3 upon driving thereof. The air whose flow rate has been adjusted in this way is introduced into a cylinder or cylinders of the internal combustion engine disposed hermetically downstream of the intake throttle valve 1 to be mixed with a fuel injected through a fuel injection valve (not shown) within a combustion chamber defined within the engine cylinder, the air-fuel mixture being then ignited.

By virtue of the structure of the intake throttle valve apparatus in which the output gear 12 and the input gear 13 directly mesh or engage with each other, as described above, the inter-axis distance between the motor shaft 11 and the valve shaft 7 is remarkably shortened when compared with that of the conventional intake throttle valve apparatus because of absence of the intermediate gear interposed between the output gear 12 and the input gear 13, to an advantage. Besides, the intake throttle valve apparatus can be manufactured in light weight with improved layout of the components, to another advantage. Owing to these features, the intake throttle valve apparatus according to the present invention can profitably be employed in a compact type gasoline engine car. More specifically, the intake throttle valve apparatus according to the invention can profitably find application to the gasoline engine car whose cylinder volume is 1.0 liter or less.

Moreover, in the case of the intake throttle valve apparatus according to the present invention, the intermediate gear and the supporting gear pin required in the case of the conventional intake throttle valve apparatus are rendered unnecessary, i.e., can be spared. Consequently, the configuration of the valve housing 4 can be simplified when compared with the conventional one. Accordingly, even when the valve housing 4 is fabricated of a resin by molding, the roundness and the cylindricity of the inner diametrical surface of the intake passage 8 can be realized with an enhanced accuracy or precision as demanded for ensuring satisfactory performance of the intake throttle valve apparatus. Besides, because the valve housing 4 can be formed of a resin, which has heretofore been difficult to realize on a mass-production scale, the valve housing 4 can be manufactured in light weight at low cost.

Furthermore, in the case of the intake throttle valve apparatus according to the present invention, the module of the output gear 12 is in the range of "0.4" to "1.0" with the number of the teeth thereof being "4" to "8". On the other hand, the module of the input gear 13 is in the range of "0.4" to "1.0" with the number of the teeth thereof being "70" to "100". Thus, the reduction ratio of the gear train including the output gear 12 and the input gear 13 is around "10". By virtue of the reduction gear mechanism constituted by the output and input gears mentioned above, the torque generated by the driving motor 3 can be increased to the magnitude which is required for controlling satisfactorily the opening degree defined by the valve element 9.

Furthermore, since the output gear 12 is so mounted on the motor shaft 11 that the gear-tooth portion 15 is distanced from the tip end of the motor shaft 11 in the axial direction, the number of the teeth of the output gear 12 as well as the module thereof can be decreased or reduced while sustaining the predetermined diameter as well as the predetermined mechanical strength of the motor shaft 11.

Besides, since the output gear 12 can be fabricated through a sintering process or a cold forging process, the predetermined mechanical strength can be ensured for the output gear 12.

In addition, because the output gear 12 is secured to the motor shaft 11 through the press fitting, the mounting strength or rigidity of the output gear 12 can easily be ensured.

Many modifications and variations of the present invention are possible in the light of the above techniques. It is therefore to be understood that within the scope of the appended claims, the invention may be practiced otherwise than as specifically described.

What is claimed is:

1. An intake throttle valve apparatus, comprising:

an intake throttle valve including a valve housing, a valve shaft rotatably supported within said valve housing and a valve element fixedly mounted on said valve shaft for changing an opening area of an intake passage formed internally of said valve housing, a reduction gear mechanism operatively coupled to said intake throttle valve, and a driving motor operatively coupled to said reduction gear mechanism so that a driving force of said driving motor is transmitted to said valve shaft through the medium of said reduction gear mechanism for thereby changing said opening area of said intake passage through rotation of said valve element, wherein said reduction gear mechanism is composed of an output gear fixedly secured to a motor shaft of said driving motor and an input gear fixedly secured to said valve shaft at one end thereof and directly meshing with said output gear, and said output gear is so mounted on said motor shaft that a gear-tooth portion is distanced from the tip end of said motor shaft in the axial direction.

2. An intake throttle valve apparatus according to claim 1, wherein module of said output gear is in a range of "0.4" to "1.0" with the number of teeth thereof being in a range of "4" to "8", while module of said input gear is in a range of "0.4" to "1.0" with the number of teeth thereof being in a range of "70" to "100".

3. An intake throttle valve apparatus according to claim 1, wherein said motor is provided with said valve housing in the radial direction of said valve shaft.

4. An intake throttle valve apparatus according to claim 1, wherein said output gear is fabricated through a sintering process or alternatively a cold forging process.

5. An intake throttle valve apparatus according to claim 1, wherein said output gear is secured to said motor shaft by press-fitting.

6. An intake throttle valve apparatus according to claim 1, wherein said valve housing is formed of a resin.

7. An intake throttle valve apparatus according to claim 1,. wherein said intake throttle valve apparatus is designed to be installed on a gasoline engine car whose cylinder volume is 1.0 liter or less.

8. An intake valve apparatus according to claim 1, wherein a reduction ratio is approximately 10.

* * * * *